US006382959B2

(12) United States Patent
Turk et al.

(10) Patent No.: US 6,382,959 B2
(45) Date of Patent: May 7, 2002

(54) BURNER WITH AIR FLOW ADJUSTMENT

(75) Inventors: Victor J. Turk, Elyria; John M. Laisy, N. Royalton, both of OH (US); Len Fisher, Colrain, MA (US)

(73) Assignee: R. W. Beckett Corporation, North Ridgeville, OH (US)

( * ) Notice: Subject to any disclaimer, the term of this patent is extended or adjusted under 35 U.S.C. 154(b) by 0 days.

(21) Appl. No.: 09/753,331

(22) Filed: Dec. 30, 2000

Related U.S. Application Data

(63) Continuation-in-part of application No. 09/371,993, filed on Aug. 11, 1999, now Pat. No. 6,244,855.

(51) Int. Cl.[7] ..... F23N 1/00; F23C 5/06

(52) U.S. Cl. ..... 431/12; 431/89; 431/189; 431/265; 431/351

(58) Field of Search ..... 431/2, 12, 182, 431/265, 89, 189, 183, 188, 186, 351, 353, 350, 90, 10; 239/402–406, 420, 424

(56) References Cited

U.S. PATENT DOCUMENTS

| | | | | |
|---|---|---|---|---|
| 1,373,149 | A | | 3/1921 | Ray |
| 1,394,567 | A | | 10/1921 | McDonald |
| 1,416,574 | A | | 5/1922 | Oney |
| 2,242,787 | A | | 5/1941 | Lieberherr |
| 2,325,444 | A | | 7/1943 | Vroom et al. |
| 2,393,897 | A | | 1/1946 | Glendenning |
| 2,538,460 | A | | 1/1951 | Kaveny |
| 2,585,081 | A | | 2/1952 | Bernhard |
| 2,634,806 | A | | 4/1953 | Hirtz |
| 2,925,783 | A | | 2/1960 | Zimmermann et al. |
| 3,091,182 | A | | 5/1963 | Anderson et al. |
| 3,153,438 | A | | 10/1964 | Brozozowski |
| 3,154,134 | A | | 10/1964 | Bloom |
| 3,474,969 | A | | 10/1969 | Barry |
| 3,556,700 | A | | 1/1971 | Jackson et al. |
| 3,658,289 | A | | 4/1972 | Hodges |
| 3,694,136 | A | | 9/1972 | Flournoy et al. |
| 3,799,733 | A | | 3/1974 | Tickell, Sr. |
| 3,852,022 | A | | 12/1974 | Medeot et al. |
| 3,918,885 | A | | 11/1975 | Palm et al. |
| 4,162,888 | A | | 7/1979 | Weishaupt et al. |
| 4,177,005 | A | | 12/1979 | Bozung et al. |
| 4,201,538 | A | | 5/1980 | Kopp |
| 4,239,482 | A | | 12/1980 | Durfee |
| 4,388,064 | A | | 6/1983 | Kaplan et al. |
| 4,484,887 | A | | 11/1984 | Petterson |
| 4,519,211 | A | | 5/1985 | Sedille |
| 4,551,088 | A | | 11/1985 | Stough |
| 4,566,850 | A | | 1/1986 | Grzina |
| 4,595,355 | A | | 6/1986 | Garrelfs et al. |
| 4,651,928 | A | | 3/1987 | Schmidt |
| 4,676,717 | A | | 6/1987 | Willyard, Jr. et al. |
| 4,978,293 | A | | 12/1990 | Ryno |
| 5,076,782 | A | | 12/1991 | Campbell et al. |
| 5,088,916 | A | * | 2/1992 | Furuhashi et al. ..... 431/89 |
| 5,184,949 | A | | 2/1993 | O'Brien |
| 5,219,461 | A | | 6/1993 | Hyll et al. |
| 5,961,316 | A | * | 10/1999 | Wellman et al. ..... 431/265 |
| 6,048,197 | A | * | 4/2000 | Beiler ..... 431/265 |
| 6,244,855 | B1 | * | 6/2001 | Turk et al. ..... 431/12 |

FOREIGN PATENT DOCUMENTS

| | | |
|---|---|---|
| GB | 2 247 743 B | 4/1995 |

* cited by examiner

*Primary Examiner*—James C. Yeung
(74) *Attorney, Agent, or Firm*—Watts, Hoffmann, Fisher & Heinke, Co., L.P.A.

(57) ABSTRACT

A burner includes a motor driven blower, an air tube having an inlet end portion and an outlet end portion, a housing forming an air flow path between the blower and the air tube, a nozzle for spraying liquid fuel or orifice for dispersing gas toward the outlet end portion of the air tube and a conduit for feeding the fuel to the nozzle or orifice. An air flow control device and method enable air flow and pressure to be regulated at locations near the nozzle and between the blower and the nozzle. A contour of a throttle member of the burner is designed so as to achieve a prescribed pressure in a region between the throttle member and head of the burner over the range of the burner.

12 Claims, 6 Drawing Sheets

BURNER WITH AIR FLOW ADJUSTMENT

CROSS-REFERENCE TO RELATED APPLICATIONS

This application is a Continuation-In-Part of U.S. patent application Ser. No. 09/371,993, entitled "Burner with Air Flow Adjustment," filed on Aug. 11, 1999, U.S. Pat. No. 6,244,855.

FIELD OF THE INVENTION

The present invention is directed to power burners whose air is supplied by a fan and motor and, in particular, to oil burners, gas burners and dual-fuel burners of any practical size and having improved manually adjustable air flow mechanisms.

BACKGROUND OF THE INVENTION

Conventional burners generally include an air tube having a fuel supply conduit (or two for dual fuel) extending axially within the tube. Each fuel supply conduit is connected at one end to a fuel supply pump or gas manifold and terminates at the other end near the end of the air tube where the fuel is dispensed as an oil spray or gas. The fuel is mixed with the air which has been delivered by a motor powered blower. A burner-mounted ignition system is connected to an ignition apparatus that is located adjacent to the fuel nozzle near the exit end of the air tube where it ignites the fuel-air mixture.

Burners of these types employ various mechanisms for adjusting air flow. For example, an oil burner disclosed in U.S. Pat. No. 5,184,949 employs an air gate disposed downstream of the blower for controlling the flow through an air flow passage. The position of the head may be adjusted. This fails to disclose a mechanism to control the total flow while simultaneously controlling the pressure behind the flame retention head. This pressure is important for reliable ignition and flame stability.

U.S. Pat. No. 4,651,928 to Schmitt discloses a mechanism that modulates the fuel flow by changing fuel pressure and temperature to follow the load requirement and correspondingly adjusts the air both downstream of the blower and near the nozzle to match the fuel flow by using a system of bellows with return springs. A servo control package is also included.

Burners built according to U.S. Pat. No. 4,651,928 appear more complex, more expensive, and less reliable than typical European burners, which are usually more complicated than typical North American burners. Typical North American oil burner service departments would not accept such a burner into their markets, in light of the requirement to understand and service unfamiliar and complex servos and special controls.

Historically, oil burner manufacturers have taken one of two approaches to making burners. One approach is to make a standard chassis (motor-blower with fuel pump, ignition transformer and control all pre-wired), and then provide individual air tube combinations with specified air-handling parts to match the needs of the particular furnace or boiler. These parts are determined by laboratory application tests done jointly by the burner manufacturer with the boiler or furnace manufacturer. This approach requires a large inventory of parts and a long and costly effort to get to market.

The start up of a boiler or furnace with this type of burner requires only a simple air band or air shutter adjustment. But if a lower firing rate is desired (viz., house insulation added) the technician should change the parts as specified by the manufacturer for the lower rate which he might not be familiar with or not have readily available.

The second approach to making a burner is to make a standard chassis and a standard air tube and end cone assembly plus a standard adjustable and removable drawer assembly (fuel conduit with electrodes, nozzle and nozzle adapter, and flame retention head) similar to the burner disclosed in U.S. Pat. No. 4,484,887. A common drawback with this approach has been that both the drawer assembly and the air band (or air throttle) are each adjusted separately by the installer.

Needed is a simple, low cost, reliable, efficient burner designed to operate over a wide range using a relatively high performance blower (i.e.: with high pressure and minimal watts) and using as many standard parts as is practical, which is easy for the installer to set up and adjust properly.

SUMMARY OF THE INVENTION

In general, the present invention is directed to a burner comprising a motor driven blower in a housing. An air tube has an inlet end portion and an outlet end portion and may be mounted to the housing. The housing forms an air flow path between the blower and the air tube. In an oil burner, a conduit feeds liquid fuel under pressure to the nozzle at the outlet end portion of the air tube where it sprays the fuel.

One aspect of the invention includes two throttling devices affixed to the fuel conduit coaxial to the air tube, each consisting of a tapered ring and a disk located within the ring and coaxial with it. Throttling together they control the air flow to a value proper for the fuel-input rate. The upstream throttle ring is configured to reduce the upstream pressure to a value determined to provide air to the second plate (the retention plate) to an exit velocity just low enough for reliable ignition and flame stability.

Both throttle rings may have tapers that are converging or diverging. Both minimum and maximum firing rates may be achieved by configuring the cones properly. The adjustment direction for converging and diverging cones should be opposite to one another however.

A mechanism is connected to the fuel conduit (a portion of which is preferably external to the housing) to accurately move it axially, thereby controlling the positions of the rigidly affixed throttle plate and the retention plate simultaneously. Consequently, only a single adjustment setting is needed for any firing rate within the range of the burner.

Referring to more specific features of the invention, the air flow control device adjusts the flow rate and two pressures in the air tube, P1 and P2. P1 is the pressure delivered by the blower. It is high at low flows and diminishes more or less uniformly as the flow increases. P2 is the pressure after the first air flow restrictor, and should be quite low at low rates and gradually higher at higher rates to assure good ignition and stability as the air accelerates through the second air flow restrictor to the flame zone where the pressure is near zero. This means that the throttle ring should close down to the throttle plate at the minimum setting where P1 is high, and should open up rapidly with the flow rate as P1 falls while P2 needs to rise.

A preferred configuration of the first air flow restrictor consists of a round throttle plate surrounded concentrically by a throttle ring, forming a venturi which is carefully configured to maintain P2 as described above. A preferred configuration of the second restrictor consists of a round retention head surrounded by a conical retention ring, forming a venturi, which is tapered to produce the minimum and the maximum flow rates required while P2 varies as specified for stability. In the preferred embodiment, the throttle plate and the retention plate are affixed to the fuel conduit and concentric with the air tube and at a fixed axial distance apart. Also, the throttle ring and retention head are affixed to the air tube at the same fixed axial distance apart. As the adjusting mechanism moves the fuel conduit axially, the throttle plate and retention plate are displaced equally within their respective concentric rings to accurately control the flow and maintain P2 for stable combustion and reliable ignition.

An added advantage of this invention relates to the improved uniformity and higher combustion efficiency of the flame. This results from improved air distribution in the air tube after the throttle where air approaches the flame retention head. To enhance this, several holes are incorporated in the throttle plate.

The present invention advantageously enables air pressure to be simply yet precisely controlled with the air flow control device. A user need not make an adjustment near the blower and a separate adjustment in the air tube. Instead, one air flow control device may be used to meter air pressure and air flow at locations near the nozzle and between the blower and the nozzle. This advantageously achieves a desirable range of pressure near the nozzle and results in uniform air flow. The present invention advantageously may adjust air pressure and flow to a desired level using only the air flow control device, although additional adjustment mechanisms may be used, if desired.

In a preferred embodiment of the present invention, the burner includes an air flow control device comprising a first air flow restrictor disposed between the blower and the nozzle, a second air flow restrictor disposed downstream of the first air flow restrictor relative to the direction of air flow, and a mechanism adapted to adjust the position of both the first and second restrictor plates to control air flow. The mechanism comprises a component connected to the conduit and a member that engages the component so as to move it precisely in either direction. The mechanism and the connected portion of the conduit are preferably external of the housing.

In one aspect of the invention the mechanism comprises an apertured support that extends outwardly from the housing. The mechanism component comprises an arm that is pivotally connected to the housing. A protrusion extends outwardly from the arm. The member comprises a threaded rod carried in the aperture of the support. Stops may be threadingly fixed on the rod so as to flank the protrusion, wherein rotation of the rod causes the stop members to engage the protrusion and pivotally move the arm.

In another aspect of the invention the mechanism comprises an apertured support that extends outwardly from the housing. The component comprises a threaded rod carried in the aperture of the support and fastened to the conduit. The member comprises internal threads that engage the rod, wherein rotation of the member against the support causes movement of the rod.

In another aspect of the invention, the mechanism comprises an arm that is pivotally connected to the housing. The member comprises a rack and pinion, one of the rack and pinion being connected to the housing and the other of the rack and pinion being connected to the arm. Motion that is imparted relative to the rack and pinion pivotally moves the arm.

Yet another aspect of the invention is directed to the component comprising at least one plate connected to the conduit. The member is eccentric such that movement of each plate is effected by rotating the member. The mechanism preferably comprises a plurality of plates each containing a conduit opening for receiving the conduit and an opening for receiving the member. A location of the conduit opening in one of the plurality of plates may be offset from a location of the conduit opening in another of the plurality of plates. Each plate comprises an oblong shaped opening that receives the member. Rotation of the member in the oblong shaped opening enables movement of the plate within a predetermined range of distance.

Yet another aspect of the invention is directed to a design method for calculating an optimum adjustment means. The method uses measured geometric data, derived equations, and calculations to configure a throttle ring contour that will reduce P1 to P2 at all flow rates within the adjustment range.

Many additional features, advantages and a fuller understanding of the invention will be had from the accompanying drawings and the detailed description that follows.

DETAILED DESCRIPTION OF PREFERRED EMBODIMENTS

Figure 1:
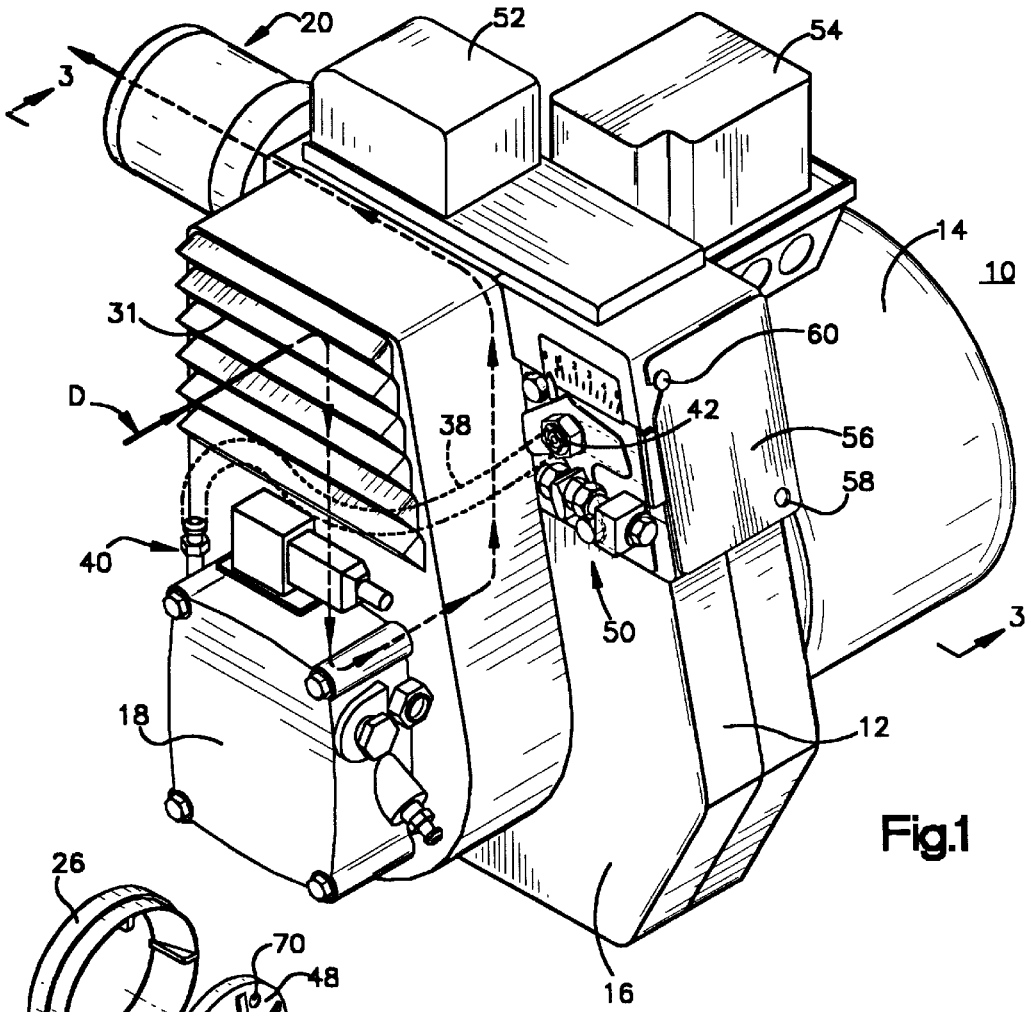
FIG. 1 is a perspective view of a burner constructed in accordance with the present invention.
Figure 2:
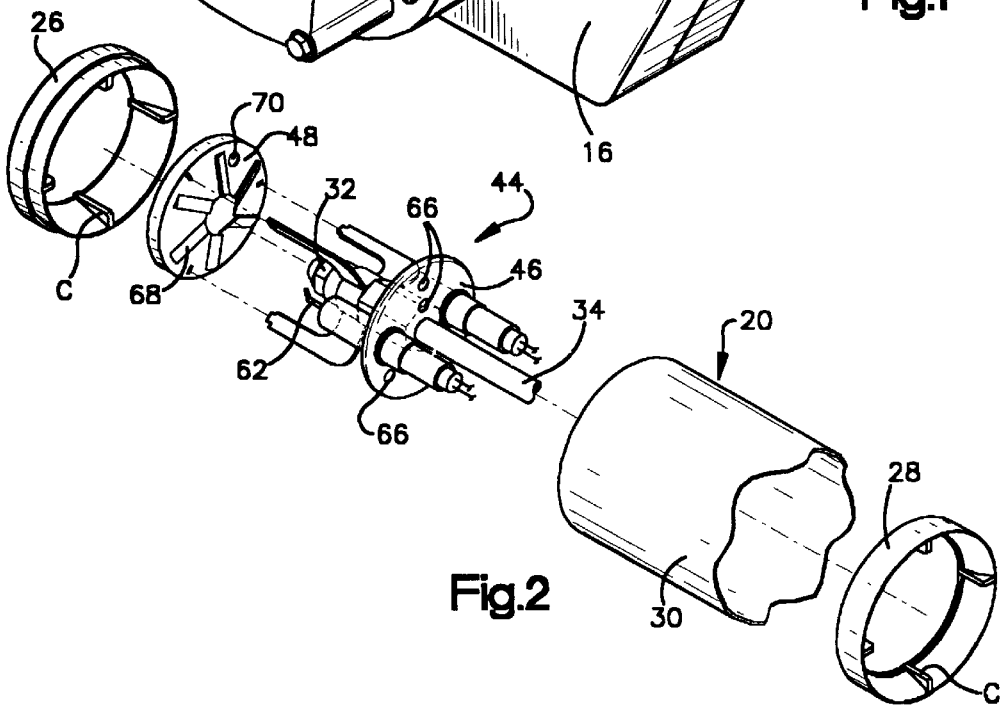
FIG. 2 is an exploded perspective view depicting a portion of the burner shown in FIG. 1.
Figure 3:
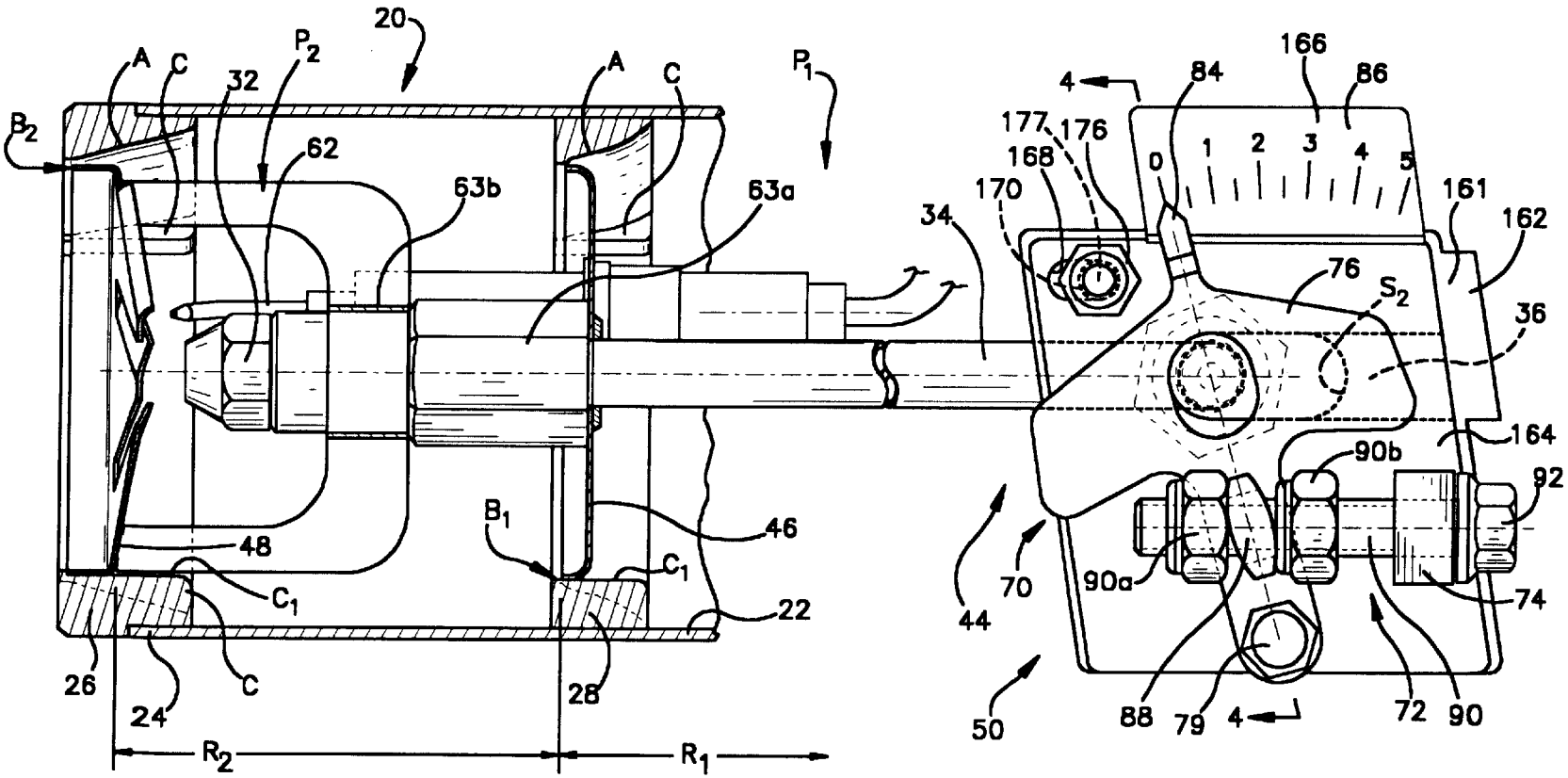
FIG. 3 is a cross-sectional view showing components at an air tube portion of the burner and one embodiment of an air flow control mechanism that operates pivotally.

Referring now to FIGS. 1–3 of the drawings, the present invention is a "gun type" oil burner generally shown at 10. The burner includes a housing 12. Contained in the housing is a motor 14 and a blower 16 that is powered by the motor, the locations of which are generally shown in FIG. 1. A fuel pump 18 that is also powered by the motor is attached to the housing and has various inlet and outlet fittings as are known in the art. An air tube 20 is fastened to the housing and has an inlet end portion 22 and an outlet end portion 24. The air tube has two restrictive sections 26 and 28 connected to a body 30 of the air tube. The housing forms an air flow path from an air inlet 31 to the blower and then through the air tube. The air flow path is depicted generally by dotted lines D. A nozzle 32 sprays oil toward the outlet end portion of the air tube. Oil from a fuel supply is pumped by the fuel pump through the conduit 34. The conduit extends within the housing and bends so as to extend out of a slot 36 formed in the housing. The housing may be formed of a plastic material or of metal (e.g., aluminum). A portion of conduit 38 leads from an outlet coupling 40 of the fuel pump and is connected to the conduit 34 with coupling 42 or one of the other couplings described hereafter.

An air flow control device 44 comprises a first or throttle plate 46 disposed at a location between the blower and the nozzle and fitting and moving inside throttle ring 28 and a second plate or retention head 48 disposed near the nozzle and fitting and moving inside retention ring 26. The throttle plate and retention head are connected to the conduit 34. The air flow control device also includes a head adjustment mechanism 50 for moving the conduit and thereby adjusting the position of the throttle plate and retention head within the throttle and retention rings, respectively, for controlling air flow and pressure.

A transformer 52 or other ignition device is mounted to the burner. Also included is an electrical controller 54 with a safety mechanism that regulates the operation of the burner in a well known manner. A back door 56 is pivotally mounted to the housing with fastener 58 and can be locked with fastener 60, once swung in place. The back door enables easy access to the interior of the burner. Electrodes 62 extend near the nozzle for igniting the fuel-air mixture into flame. The fuel may be any suitable combustible gaseous or liquid fuel such as oil. Although the burner shown in the drawings utilizes oil as the fuel, modifications to the burner suitable for enabling the use of gaseous fuel would be apparent to one skilled in the art in view of this disclosure.

As shown in FIG. 3, the throttle plate is fitted onto the conduit and held in place such as against the back of interiorly threaded member 63*a* which is threaded onto the conduit. A spider 63*b* is held in place on the member 63*a* and holds the retention head to the conduit by fingers that extend into openings in the retention head 48. Insulators of the electrodes 62 are connected to the throttle plate. The electrodes (only one of which is seen in FIG. 3) extend to a point near the nozzle for igniting the spray of oil to produce flame. The electrodes are electrically connected to the transformer or other ignition device.

The throttle ring 28 is disposed around the periphery of the throttle plate 46 and fixed to the air tube. The retention ring 26 is disposed around the periphery of the retention head 48 and fixed to the air tube. The throttle and retention rings each form a venturi in the air tube. The throttle plate and retention head move within the respective venturis. As shown in FIG. 3, the throttle and retention rings have tapered cross-sectional surfaces that extend from near the air tube progressively inwardly relative to the air flow direction. Each of the throttle plate and retention head has a circumferential surface that is sized so as to form apertures of various widths with the tapered cross-sectional surfaces of the throttle ring and retention ring, respectively. The circumferences of the throttle plate and retention head are held concentrically within the throttle ring and retention ring, respectively, by ribs C disposed about the circumference of the rings. The ribs C are concentric and their innermost portions C1 extend parallel to the central axis of the air tube for guiding the retention head and the throttle plate. A first aperture B1 begins to be formed between the surface of the throttle plate that is closest to the air tube outlet, and the corresponding surface of the retention ring, and a second aperture B2 begins to be formed between the surface of the retention head that is closest to the air tube outlet, and the corresponding surface of the retention ring. These apertures B1 and B2 are variable and increase in size when the retention head and throttle plate are moved away from the outlet end portion of the air tube. The apertures may be formed by a tapered surface in the ring and mating surface in the plate or by other shapes of these components, as long as the apertures achieve the desired pressure and flow characteristics in accordance with the present invention.

The throttle plate 46 has openings 66, some of which are shown in FIG. 2, for enabling sighting of the flame and for contributing to desired metering of air pressure and flow downstream of the throttle plate. The retention head 48 has a plurality of vaned openings 68 that provide for desirable air flow downstream of the retention head near the nozzle. The purpose of the vanes is for air/fuel mixing and flame shaping, as known to those skilled in the art. The retention head is also provided with an opening 70 for sighting the flame.

The inventive air flow control device advantageously enables air to be metered to a desired pressure and flow. In particular, the air flow control device is designed to achieve a desired pressure in the region R2, for example, a pressure of about 1 inch water column. Air in a first region R1 between the blower and the throttle plate is at a pressure P1 ranging from 1.75 to 4.50 inches water column (depending on flow). The pressure P1 is directly reduced by a first flow restrictor, (e.g., the throttle plate and ring) to a pressure P2 ranging from 0.4 to 1.1 inches water column (depending on flow). The pressure P2 in the region R2 is obtained in accordance with the present invention as a result of the air flow and pressure drop across the throttle plate and ring as well as across the retention head and ring.

The present invention advantageously meters the flow of air so that the air has a desired pressure near the nozzle in the region R2. The invention contemplates various ways to accomplish this result such as the use of multiple air flow restrictors or portions thereof that may move together or independently of one another, flow restrictors or portions thereof connected to the conduit that move upon movement of the conduit, and flow restrictors or portions thereof that are moved with mechanisms that do not rely upon movement of the conduit. In addition, the flow restrictor portions need not be plate shaped, but rather, may be any shape that enables air to be metered to a desired pressure near the nozzle in the region R2 downstream of the first air flow restrictor.

More specifically, the present invention preferably moves the throttle plate and retention head to enable the desired pressure and flow to be achieved. A preferred aspect of the invention moves the throttle plate and retention head simultaneously. The simultaneous movement of both the throttle plate and retention head with the air flow control device, enables the air flow and pressure to be conveniently controlled with a single adjustment. However, it will be appreciated by those skilled in the art in view of this disclosure that more than two plates may be used, that the plates may have different numbers and shapes of openings, and that the plates and rings may employ different geometric shapes.

The throttle ring and throttle plate meter air pressure and flow that are delivered to the retention ring and retention head. The retention ring and retention head meter air and provide mixing of air with fuel from the fuel nozzle for combustion. The throttle plate and retention head are moved toward the outlet end portion of the air tube to decrease air flow and control air pressure for decreased fuel firing rates such as those ranging from ½ gallon (gal) to 1 gal per hour. The throttle plate and retention head are moved back away from the outlet end portion of the air tube to increase air flow and control air pressure for increased fuel firing rates such as those ranging from 1⅓ gal to 2 gal per hour. The throttle plate and retention head can also be moved back to increase air flow for excess combustion air, if desired.

Figure 4:
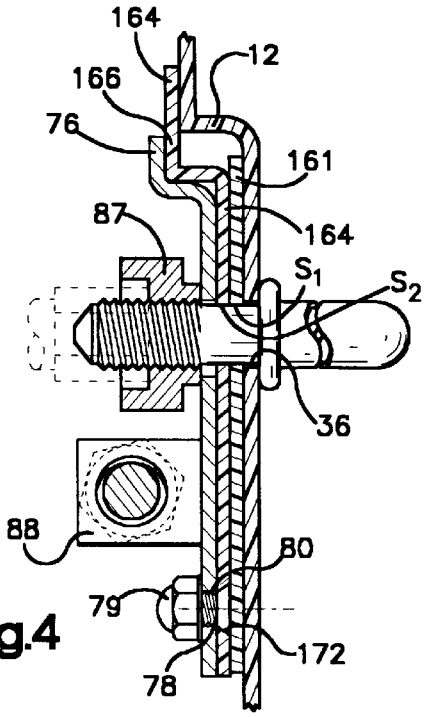
FIG. 4 is a view as seen along the lines designated 4—4 in FIG. 3.

The head adjustment mechanism comprises a component connected to the conduit and a member that moves so as to impart motion to the component and thus, the conduit. A portion of the conduit 34 that extends externally of the housing is connected to the component of the mechanism. One form of the head adjustment mechanism is shown in FIGS. 3 and 4. The mechanism comprises an anchor or support 74 that extends outwardly from the housing and is connected to an intermediate plate 164. The component 70 comprises an arm 76 that is pivotally connected to the intermediate plate 164 such as by stud 78 and nut 79 as will be described in more detail hereafter. The arm preferably has a pointer portion 84 that points to readings on an indicator 86 that correspond to desired firing conditions. A coupling 87 is threaded onto a portion of the conduit 34 to lock the conduit to the arm. A cam shaped, apertured protrusion 88 extends outwardly from the arm and is disposed between nuts or stops 90*a*, 90*b* that are fixed in place on a threaded rod or bolt 90 carried by the support 74. Rotation of a head 92 of the rod causes the stop members to engage the protrusion and pivotally move the arm in view of the cam shape of the protrusion. When the bolt is rotated so as to pull the nut 90*a* against the protrusion to the right in the view shown in FIG. 3, the arm and conduit are retracted away from the air tube outlet to enable greater air flow in the air tube at the first and second air flow restrictor areas. Conversely, when the bolt is rotated so as to push the nut 90*b* and move the protrusion to the left in the view shown in FIG. 3, the arm and conduit are moved toward the air tube outlet to restrict more air flow. The bolt may be turned by relatively small increments to enable precise air flow and pressure control as shown on the indicator.

Figure 5:
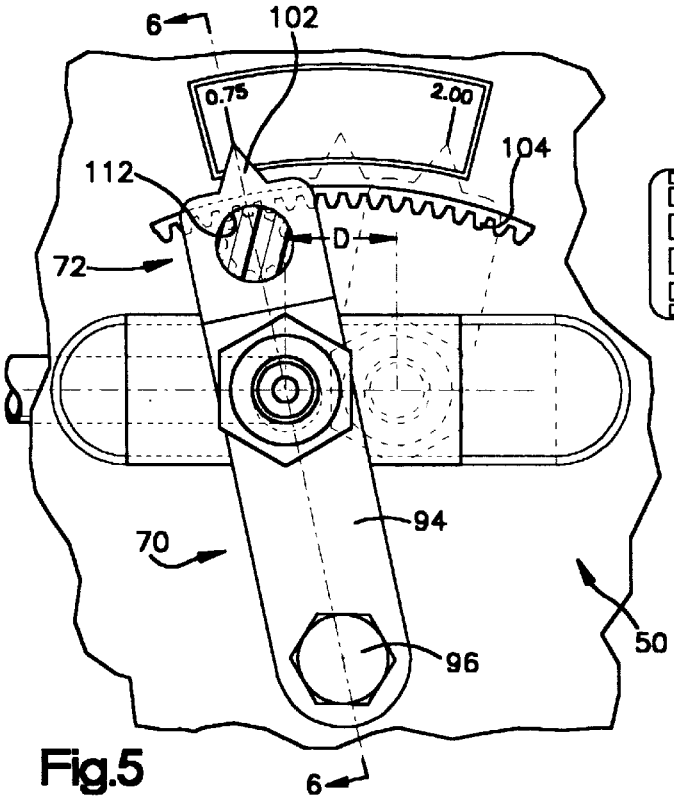
FIG. 5 is a view depicting another embodiment of the air flow control mechanism that operates using a rack and pinion.
Figure 6:
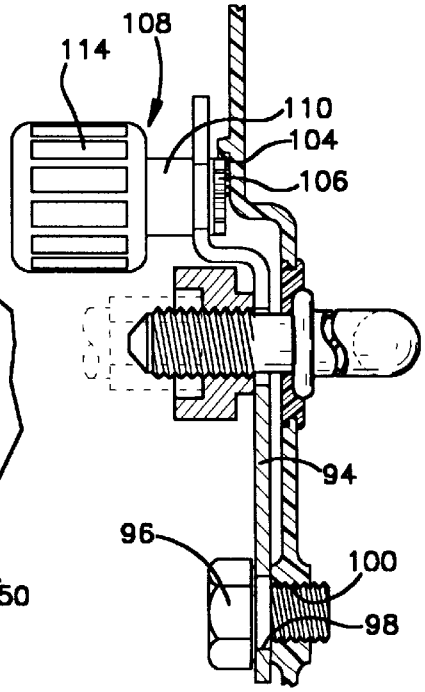
FIG. 6 is a cross-sectional view as seen from the lines designated 6—6 in FIG. 5.
Figure 7:
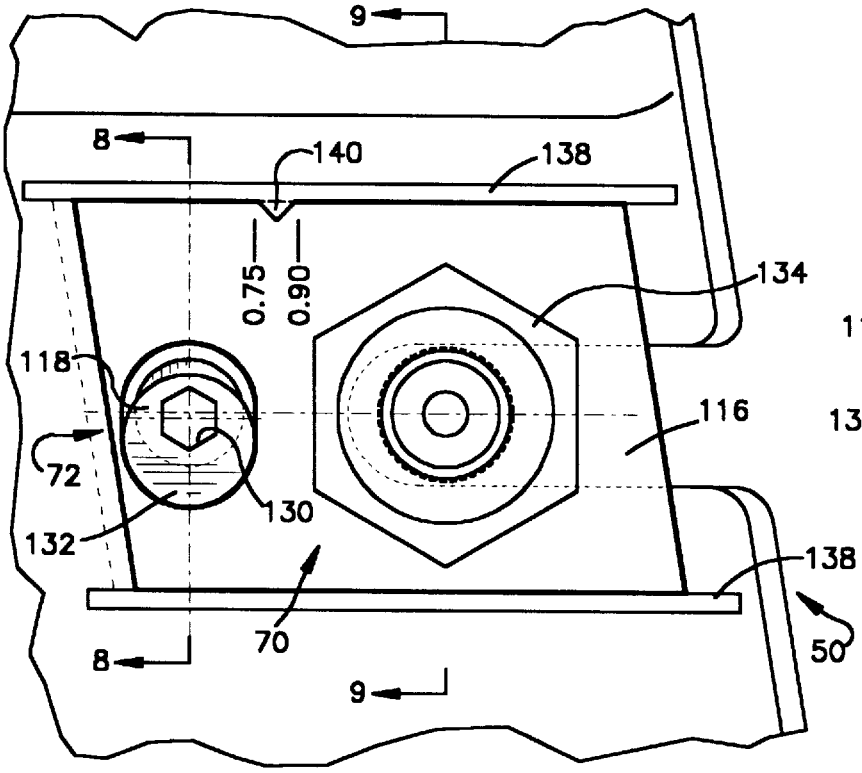
FIG. 7 is a view depicting another embodiment of the air flow control mechanism.
Figure 8:
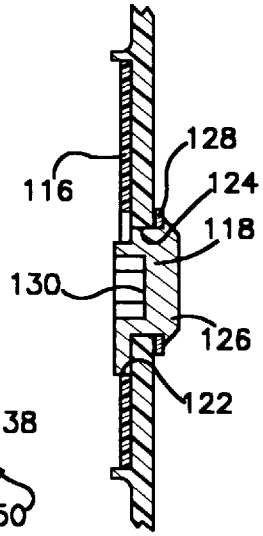
FIG. 8 is a cross-sectional view as seen along the lines designated 8—8 in FIG. 7.
Figure 9:
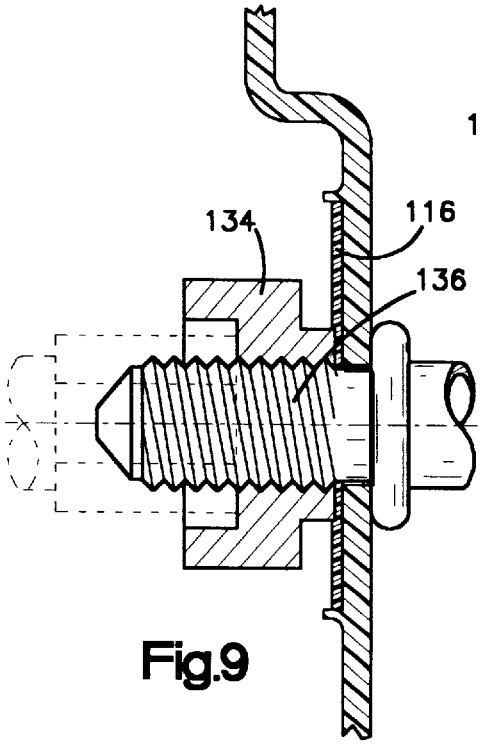
FIG. 9 is a cross-sectional view as seen along the lines designated 9—9 in FIG. 7.

Another head adjustment mechanism shown in FIGS. 5 and 6 comprises a component 70 that includes an arm 94 that is pivotally connected to the housing such as by a bolt 96. The bolt 96 extends through an opening 98 in the arm and into a threaded opening 100 formed in the housing. The arm includes a pointer portion 102 that points at readings on an indicator that correspond to desired firing conditions. The member 72 comprises a rack 104 and pinion 106. The rack is connected to the housing. A rotatable component 108 includes a shaft 110 that extends through an opening 112 in the arm and the pinion 106 that is configured so as to engage the rack. When a dial 114 is rotated, it causes the pinion to move along the rack, which pivots the arm and, in turn, moves the conduit. Clockwise rotation of the dial causes the arm to pivot to the left as depicted in the view of FIG. 5 and moves the conduit toward the air tube outlet, resulting in more restricted air flow. Counterclockwise rotation of the dial causes the arm to pivot to the right as seen in the view of FIG. 5 and retracts the conduit from the air tube outlet, resulting in more air flow.

Another embodiment of the head adjustment mechanism is shown in FIGS. 7–11 and comprises at least one plate 116, one of which is connected to the conduit at a time. The member 72 is in the form of an eccentric 118. Rotation of the eccentric moves each plate. The mechanism preferably comprises a plurality of plates 116 (only one of which is shown) each containing an opening 120 for receiving the conduit and an opening 122 for receiving the eccentric. The eccentric may be received in an opening 124 in the housing and at an inward end may include a shoulder 126. Between the shoulder 126 and the housing is a snap-fit ring 128 or the like for rotatably securing the eccentric to the housing. The eccentric has a socket 130 disposed in an offset location so as to form a major plate engaging section 132. A coupling 134 may be threaded onto threads 136 of the conduit 34 to lock the conduit to the plate. The plate may be received by upper and lower guides 138. A pointer 140 extends from one of the guides and indicates the fuel firing rate with readings printed on each plate.

A location of the conduit opening 120 in one of the plates is offset from a location of the conduit opening 120 in another of the plates. For example, the conduit opening may be displaced in succession from the eccentric opening by a distance of ⅛ inch from a previous plate in the series of plates. The plates are used one at a time. Therefore, a first plate in the series of plates with its conduit opening all the way to the left enables the lowest fuel firing rate with a range determined by the degree of movement of the eccentric. A second successive plate in the series of plates with the conduit opening displaced ⅛ inch further right than the first plate would have a higher fuel firing rate compared to the first plate with the same range of fuel firing rates as the first plate, and so on for successive plates. For example, when a higher fuel firing rate is desired, the plate would be replaced by one in which the conduit opening is spaced further to the right away from the eccentric opening.

Figure 10:
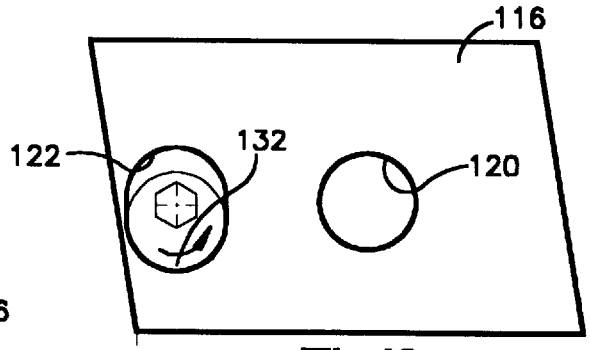
FIGS. 10 and 11 depict movement of a plate of the air flow control mechanism of FIG. 7.
Figure 11:
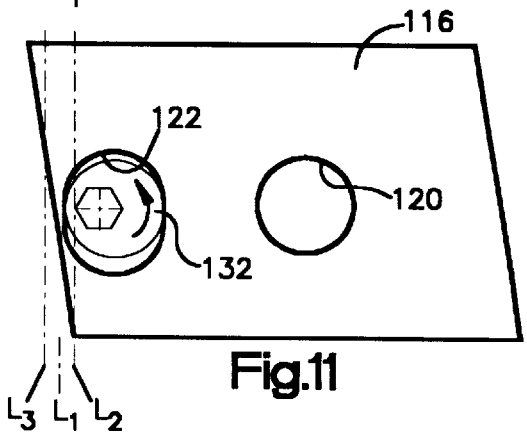

As shown in FIG. 10, the plate is in a neutral position that is not being moved by the eccentric. Counterclockwise rotation of the eccentric moves its plate engaging section 132 and, in turn, moves the plate to the right from a position L1 to a position L2 shown in FIG. 11. This moves the conduit out and increases the amount of air flow. Conversely, clockwise rotation of the eccentric from the position shown in FIG. 10 moves the engaging section and, in turn, moves the plate to the left from the position L1 to the position L3 shown in FIG. 11. This moves the conduit in toward the air tube outlet and increases the restriction of air flow.

Figure 14:
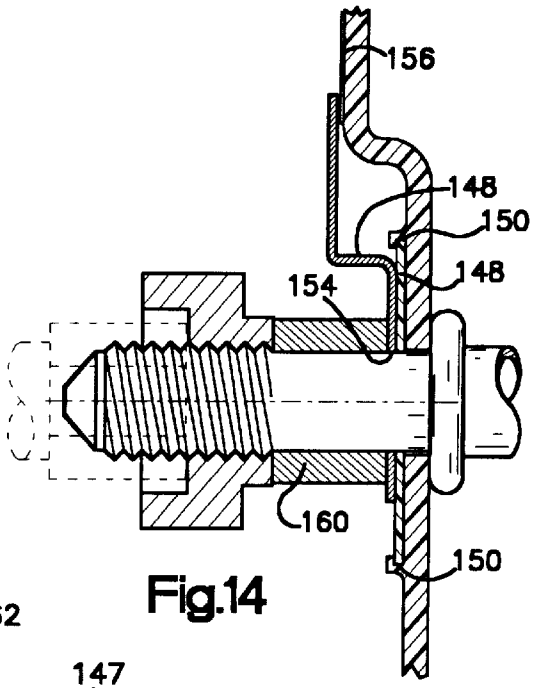
FIG. 14 is a cross-sectional view as seen along the lines designated 14—14 in FIG. 12.
Figure 13:
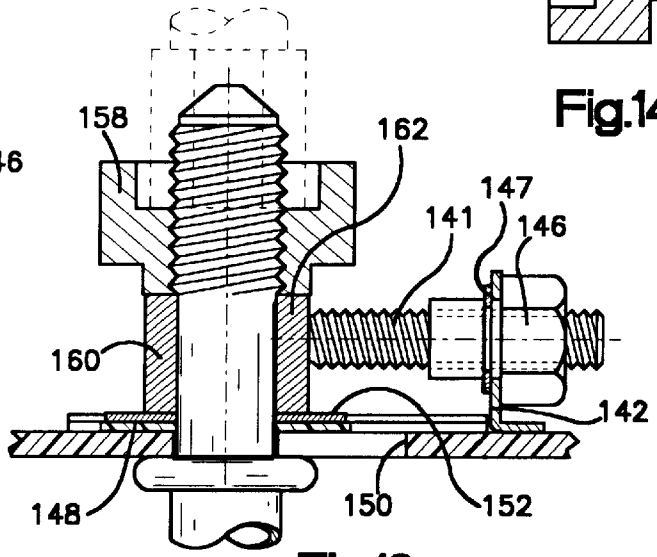
FIG. 13 is a cross-sectional view as seen along the lines designated 13—13 in FIG. 12.
Figure 12:
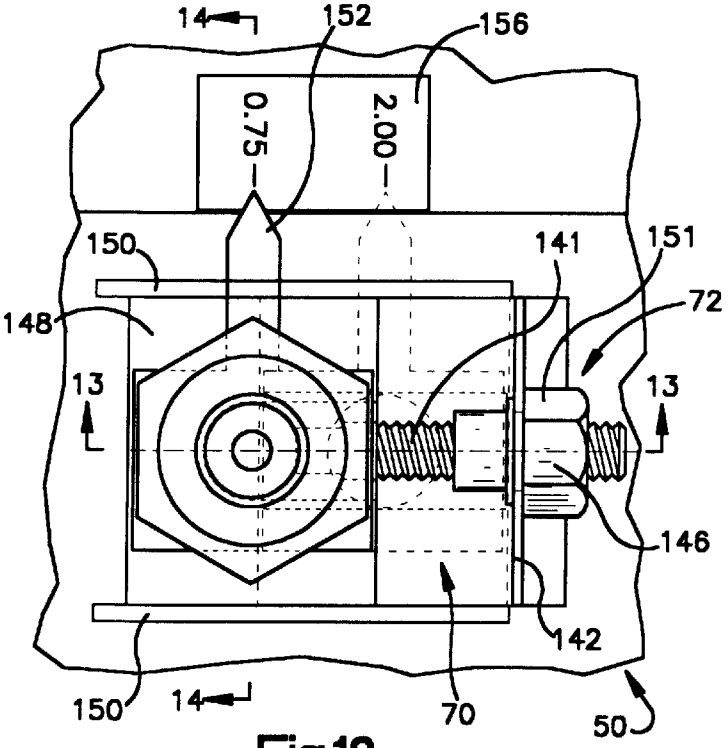
FIG. 12 is another embodiment of the air flow control mechanism that moves linearly.

Yet another embodiment of the head adjustment mechanism is shown in FIGS. 12–14 and comprises a support 142 that extends outwardly from and is connected to the housing. The component 70 comprises a threaded rod 141 carried in an aperture of the support. An internally threaded member such as a nut 146 is rotatably secured to the rod such as with a snap-fit ring 147 on a collar of the nut, or the like. A plate 148 is secured to the housing between upper and lower guides 150. A slot 151 is formed in the housing. A pointer 152 may include an aperture 154 that receives the conduit. An indicator plate 156 may be secured to the housing as shown in FIG. 12. The conduit 34 is connected to the housing by an interiorly threaded coupling 158. A collar member 160 is disposed between the coupling and the plate 148. The rod 141 is fastened to the collar 160 such as by welding. Rotation of the nut 146 on the rod 141 and against the support 142 causes the rod and, in turn the conduit, to move linearly either to the left or right as depicted in FIG. 12 and causes the conduit to move in and out, respectively. As shown in FIG. 12, movement of the rod to the left increases restriction of air flow whereas movement to the right increases air flow. The plate 148 may move with the arm and covers portions of the slot 151.

Figure 3A:
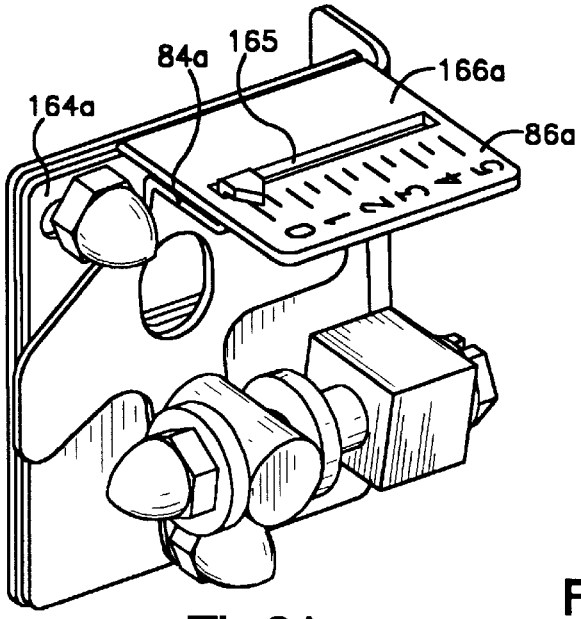
FIG. 3A is a perspective view showing another aspect of the air flow control mechanism of FIG. 3.

The head adjustment mechanism is zeroed in using the mechanism of FIGS. 3 and 4, for example, by a procedure that includes inserting the conduit-head-electrode subassembly all the way to the outlet end of the air tube where it engages the ring 26 and stops. A back plate 161 of the mechanism includes a portion 162 that bends around the corner of the burner and is trapped by the door 56. The back plate 161 has a slot S1 that corresponds to the slot 36 formed in the housing. Disposed on the back plate is an intermediate plate 164, which includes a bent portion 166 that forms the indicator 86. Another aspect of the air flow control mechanism is shown in FIG. 3A which is similar to FIG. 3 and where like numerals designate like parts. A pointer portion 84*a* is bent to extend through an opening 165 in a bent portion 166*a* of indicator 86*a* that forms a part of the intermediate plate 164*a*. The intermediate plate has a slot S2 that corresponds to the slot 36 in the housing but is shorter. A zeroing slot 168 is disposed in the intermediate plate 164, for accommodating variations in tolerance. The stud 78 passes through the opening 80 in the arm, is staked in countersunk opening 172 in the intermediate plate, and held in place with nut 79 to act as a pivot point for the arm. With the conduit furthermost toward the air tube outlet, the arm and intermediate plate are moved together as an assembly on the fixed backplate so as to position the pointer at the zero position on the indicator of the plate. A zeroing nut 176 threadingly engages a stud 177 that is passed through the slot 168 in the intermediate plate 164 and is staked into an opening 170 in the backplate 161 to lock the plates in position. Any of the mechanisms described may be adapted to utilize the zeroing procedure described above.

The mechanism is operated in the manner described to regulate air flow and pressure in the second region R2. The air flow control device regulates air at a pressure P1 in the first region R1 to reduce the pressure P1 to a pressure P2 in the second region R2. This is accomplished by moving the conduit either in or out of the air tube into the flow restricting or flow increasing positions. Therefore, the invention advantageously enables easy, consistent and precisely controlled air pressure and uniform air flow in the burner.

Another feature of this invention is a design method for calculating an optimum adjustment means over the operational range of the burner. A near-optimum adjustment over the entire range of a burner can be prepared ahead of time in the configuration of a two-stage air control system. The optimal P2 and consequent air velocity leaving the head apertures for each firing rate is determined empirically by iterative combustion tests at gradually increasing values of P2 and with correspondingly decreasing head positions at incipient smoke (the trace point). With each iteration the trace-point and $CO_2$ or $O_2$ are recorded, and the corresponding excess air is invariably reduced because the mixing is more rapid and more complete. Eventually at higher air velocities the flame will become unstable or will not reliably ignite. The optimal P2 for each head position is lower than this critical setting. The optimum is the highest P2 that assures a stable flame with reliable ignition under some of the common less than ideal conditions found in normal field applications such as cold oil and cool air.

In the design process, after the fan performance is established and the retention head is designed, the retention ring, preferably a right circular cone, is configured so that its minimum diameter will result in just enough secondary air around the outside of the head when set at zero to provide zero excess air for the lowest firing rate at the optimal P2 setting. The maximum diameter of the retention ring will be just large enough to provide the necessary secondary air to yield a safe excess air margin above the trace point and also to tolerate field conditions as conceived by the market. This is near 10–11% $CO_2$ in U.S. markets, for example.

The axial length of the retention ring is a matter of choice and is related to the sensitivity of the axial adjustment mechanism. As an example for a small domestic burner with a fuel rate range of 0.5 to 1.35 U.S. gph ⅝" was used, and a straight-tapered cone was selected for simplicity and for near-uniform adjustment characteristics.

As the adjustment is increased the clearance around the head increases, and the flow for any head position (i.e., adjustment from zero) increases uniformly. The flow through and around the head for any head position can be calculated based on the fixed openings in the head and the variable clearance area around it. The driving pressure, P2, and the flow coefficients provide the remaining factors along with the areas to solve for airflow at any head position. The ratio between fuel flow and required airflow with zero excess air is well known and can be multiplied by (1+e) for excess air fractions, where e=fraction of excess air Thus the recommended or optimum head position for any firing rate is available having been tested at a P2 optimized for stability and reliability at incipient smoke.

Figure 15:
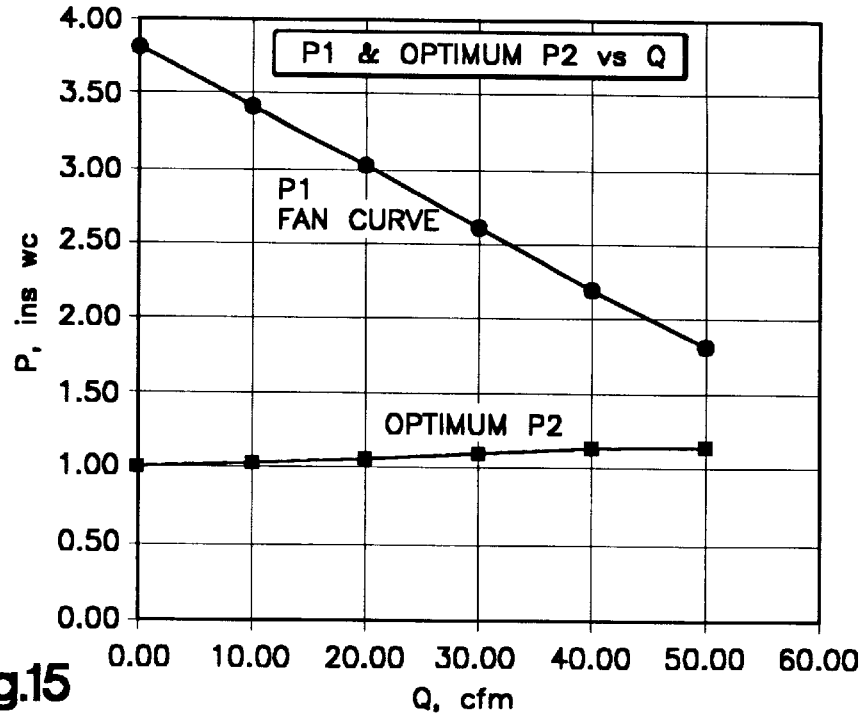
FIG. 15 is graph of blower performance data.

The configuration of the throttle plate and its relationship to the retention head assembly described above are factored into the design of the throttle ring. Prerequisite to configuring the throttle assembly is documenting the blower performance data or performance curve (viz., P1 vs. air flow rate) as shown in FIG. 15, which graphs a typical P1 and optimum P2 pressure—air flow relationship, along with the head assembly performance (viz., optimum P2 vs. air flow rate and air flow rate vs. head position, X). The throttle plate reduces the fan pressure from P1 to the said optimum P2 at that airflow rate. Since both the throttle plate and the retention head are affixed to the fuel conduit, each will move equally from its zero or minimum position to its maximum position. The flow characteristics of the throttle assembly must meet the requirements of the head assembly over the full range of axial adjustment.

Starting with a specific throttle plate configuration and the head-and-ring assembly design, a method for configuring a throttle ring contour that will reduce P1 to P2 at all flow rates within the adjustment range is the final step to meeting this aspect of the invention. Because the optimum air fuel ratio is constant an optimal setting can be made for any fuel rate (gph) using the single adjustment.

The preferred throttle plate is a rigid circular disc perforated with enough holes to provide uniform airflow distribution; one or more to allow the flame sensor to see the flame. It may be flanged for rigidity and the flange rounded in the downstream direction for increased streamlining, or the flange may extend upstream to reduce flow if required. The number and size of the holes are such that they provide by themselves either some or most of the theoretical air required for the lowest recommended firing rate with the adjustment at zero.

The rest of this air requirement is supplied by the minimum annular clearance area, AV1, between the throttle plate (while set at zero) and the throttle ring. The area required to supply this secondary air, at rate QV1, is based on the known values:

Q=the total flow through the burner, based upon the fuel flow rate and the air/fuel ratio;

AV1=the annular clearance area between the throttle plate and the throttle ring;

QV1=the air flow rate through the annular clearance area, AV1;

CV1=the discharge coefficient of the annular clearance area, AV1;

P1=the blower discharge pressure upstream of the first restrictor and is a function of Q;

P2=the optimum pressure downstream of the first restrictor and upstream of the second restrictor;

AC1=the total fixed aperture area in the throttle plate;

QC1=the air flow through the fixed aperture area in the throttle plate, AC1;

CC1=the discharge coefficient of the fixed aperture, AC1;

R1=the throttle plate outside radius;

R2=the throttle ring inside radius;

Ve1=the air velocity generated by P1–P2;

X=the displacement of the throttle ring or retention head from the zero position;

S=the length of the segment normal (perpendicular) to air flow through the annular space between the throttle plate and throttle ring;

ρW=the density of water;

ρA=the density of air; and g=the acceleration due to gravity; and the following relationships:

$$Ve1=(2g(P1-P2)\cdot(\rho W/\rho A))^{1/2} \quad (1)$$

$$QV1=Q-QC1 \quad (2)$$

$$QC1=CC1\cdot AC1(2g(P1—P2)\cdot(\rho W/\rho A)^{1/2} \quad (3)$$

$$AV1=QV1/(CV1\cdot Ve1), \quad (4)$$

and $$AV1=\pi(R2^2-R1^2) \quad (5).$$

The minimum (zero-position) throttle ring radius, R2, based on the throttle plate radius, R1, can therefore be derived from AV1 by:

$$R2^2=AV1/\pi+R1^2 \text{ or } R2=(AV1/\pi+R1^2)^{1/2} \quad (6)$$

At this point we can define the retention head, the retention ring, the throttle plate and the minimum radius of the throttle ring, R2, (at X=0). The final requirement is to complete the contour of the throttle ring, i.e., the remaining radii, R2, for the throttle ring for the full range of adjustment. The procedure is similar to determining the minimum R2, but since the higher-range flows through the annular gap are not axial, but conical, it is necessary to define these transverse flow areas based upon finite conical elements that are essentially normal (perpendicular) to the airflow path.

Figure 16:
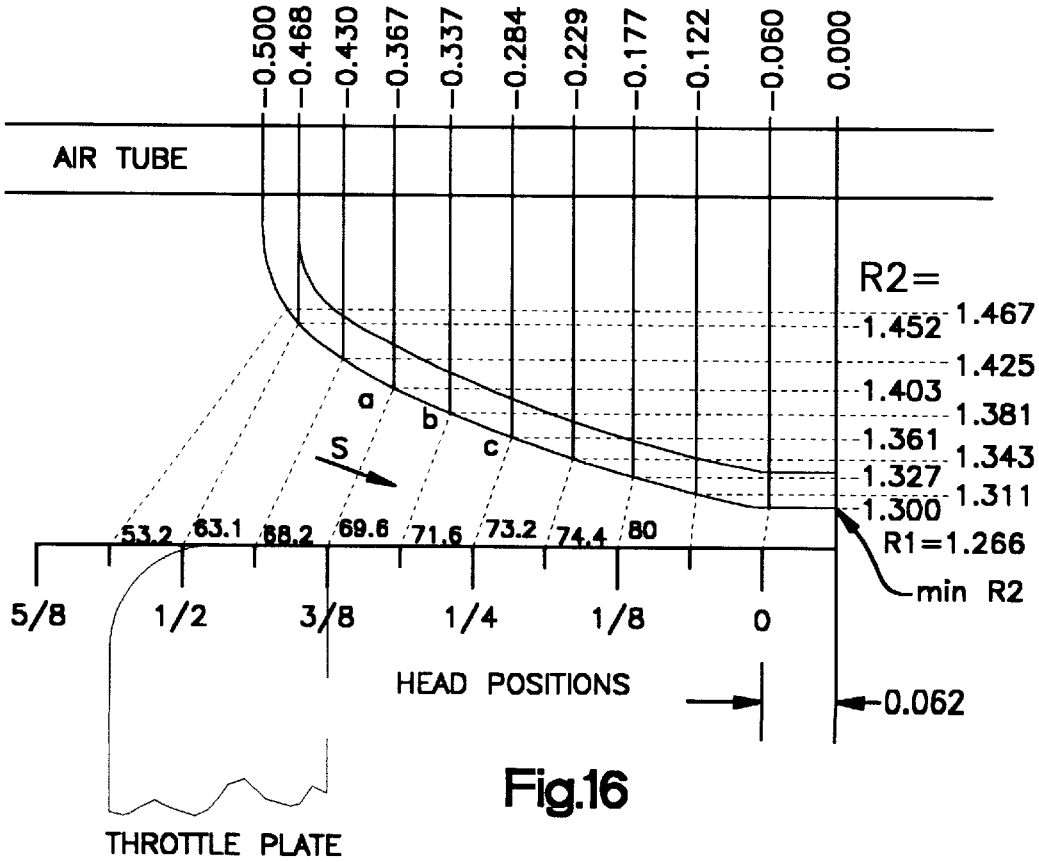
FIG. 16 is a graph of the calculation of the throttle ring contour

Although the slope of the optimized inside throttle wall is not defined a priori at any given head setting, it can be very closely evaluated in the design protocol by assuming small incremental adjustments to the head position, X, and letting the transverse line, S, at each incremental setting be perpendicular to the slope of the wall at the prior incremental setting which had been determined previously. For example, in FIG. 16, illustrating the calculation of throttle ring contour, the transverse line, S, terminating at 'a' for X=⅜" is perpendicular to the wall segment b-c, not a-b, and the length of S is solved from the area of the cone of S that equals AV1 for X=⅜". The area of the conical surface is:

$$AV1=\pi\cdot S\cdot(R1+R2) \quad (7)$$

and combining with Equation (4) gives us, $$\cdot S\cdot(R1+R2)=QV1/(CV1\cdot Ve1). \quad (8)$$

S and R2 are the only remaining unknowns, and in the example, R2=S·sin(69.6°)+R1, leaving S the only unknown. Its solution provides the coordinates of point 'a': (−0.387 and 1.403).

This procedure typifies a preferred method for defining the coordinates of a throttle contour matched optimally to a given retention head, retention ring, blower performance, throttle plate, and air tube. It will be understood by those skilled in the art in view of this disclosure that other configurations and orientations of the throttle surface are possible in accordance with the present invention and may be calculated based upon the above described mathematical relationships of the present invention or similar relationships. For instance, the tapered or contoured surface may be on a central throttle member and the outer throttle member may take the form of a throttle ring in the shape of a plate; and the throttle ring may move while the central throttle member is stationary. Also, other configurations of the tapered surface other than what is shown in the drawings is possible. The performance criteria and method described to configure an optimized throttle ring contour for a burner is not known in the prior art.

Many modifications and variations of the invention will be apparent to those skilled in the art in light of the foregoing disclosure. Therefore, it is to be understood that, within the scope of the appended claims, the invention can be practiced otherwise than has been specifically shown and described.

What is claimed is:

1. A method of designing a throttle ring for use in a burner so as to reduce a first blower pressure P1 upstream of a throttle plate movable within the throttle ring to a prescribed pressure P2 between the throttle plate and a retention plate downstream of the throttle plate at an adjustment range of the throttle plate within the throttle ring between a minimum air flow position and a maximum air flow position, comprising the steps of:

measuring P1 values as a function of a range of flow rate values Q through the burner;

measuring prescribed P2 values as a function of the range of flow rate values Q through the burner;

measuring the air flow rate values Q through the burner as a function of movement of the retention plate within a retention ring of the burner distances X from the minimum flow position to the maximum flow position, the retention plate and the throttle plate being interconnected so as to move together;

selecting a radius R1 of the throttle plate;

selecting apertures in the throttle plate which provide air for a low firing rate at the minimum air flow position;

calculating a minimum throttle ring radius R2 when the throttle plate is located at the minimum air flow position, using:

(i) the following known or measured values:

the air flow Q through the burner=the total flow through the burner, based upon a prescribed fuel flow rate and prescribed air/fuel ratio of said burner, AV1=an annular clearance area between the throttle plate and the throttle ring, QV1=an air flow rate through said annular clearance area AV1, CV1=a discharge coefficient of said annular clearance area AV1, P1=the blower discharge pressure upstream of the throttle plate, P2=the prescribed pressure between the throttle plate and the retention plate, AC1=a total fixed aperture area in the throttle plate, QC1=air flow through said fixed area AC1, CC1=a discharge coefficient of said fixed area AC1, R1=the throttle plate outside radius, R2=the throttle ring inside radius, Ve1=the air velocity generated by P1–P2, X=the displacement of the throttle plate or retention plate from the minimum air flow position, S=the length of a segment normal to air flow through the annular space between the throttle plate and the throttle ring, ρW=the density of water, ρA=the density of air, g=the acceleration due to gravity;and (ii) the equation, $R2=(AV1/B+R1^2)^{1/2}$ based on the following relationships (1)–(5):

$$Ve1=(2g(P1-P2)\cdot(\rho W/\rho A))^{1/2} \quad (1)$$

$$QV1=Q-QC1 \quad (2)$$

$$QC1=CC1\cdot AC1(2g(P1-P2)\cdot(\rho W/\rho A))^{1/2} \quad (3)$$

$$AV1=QV1/(CV1\cdot Ve1), \quad (4)$$

$$AV1=\pi(R2^2-R1^2) \quad (5);$$

and determining a contoured surface of the throttle ring comprising the steps of:

(a) assuming a plurality of small incremental adjustments of the throttle plate from the minimum air flow position toward the maximum air flow position along the central axis resulting in a segment at each increment on a reference line parallel to the central axis, (b) locating a transverse line S at the start of a segment at an angle θ between said transverse line S and said reference line which is perpendicular to a section of said contoured surface corresponding to a prior segment nearer to said minimum flow position, said transverse line S being positioned to extend from the reference line, (c) inserting the angle θ into the equation, $R2=S\cdot\sin(\theta)+R1$, (d) determining a length of the transverse line S by substituting the equation resulting from step (c) into the equation, $\pi\cdot S\cdot(R1+R2)=QV1/(CV1\cdot Ve1)$, thereby determining the coordinates of a point at said contoured surface of said throttle ring, and (e) repeating steps (b) through (d) to determine all of the points desired at the contoured surface of said throttle ring.

2. The method of claim 1 comprising fabricating said throttle ring to include said contoured surface resulting from connecting said points.

3. A burner made according to the method of claim 2.

4. A method of designing a contoured peripheral surface of an air flow restrictor for use in a burner so as to reduce a first blower pressure P1 upstream of said air flow restrictor in a direction of air flow in the burner to a prescribed pressure P2 between said air flow restrictor and a burner head at an adjustment range of said air flow restrictor between a minimum air flow position and a maximum air flow position, said air flow restrictor comprising one component comprising said contoured surface and another component comprising a throttle plate having a peripheral surface, one of said components being movable relative to the other, said method comprising the steps of:

measuring performance data of the burner;

selecting a radius R1 of said throttle plate;

selecting an area of apertures in said throttle plate which provide air for a low firing rate at the minimum air flow position;

calculating a minimum of a radius R2 of said contoured surface which occurs when said throttle plate is located at the minimum air flow position, using the equation, $R2=(AV1/\pi+R1^2)^{1/2}$, where AV1=a calculated annular clearance area between said throttle plate and said contoured surface based upon said performance data, determining a shape of said contoured surface comprising the steps of:

(a) assuming a plurality of small incremental adjustments of said movable component from the minimum air flow position toward the maximum air flow position along the central axis resulting in a segment at each increment on a reference line along the central axis, (b) locating a transverse line S at the start of a segment at an angle θ between said transverse line S and said reference line which is perpendicular to a section of said contoured surface corresponding to a prior segment nearer to said minimum flow position, said transverse line S being positioned to extend from the reference line, (c) inserting the angle θ into a trigonometric function as to the equality of R2 in which the transverse line S is an unknown, (d) determining a length of the transverse line S by substituting the equation resulting from step (c) into the equation, $\pi\cdot S\cdot(R1+R2)=QV1/(CV1\cdot Vel)$, where QV1, AV1 and Ve1 utilize said measured performance data and QV1=an air flow rate through said annular clearance area AV1, CV1=a discharge coefficient of said annular clearance area AV1, and Ve1=the air velocity generated by P1–P2, thereby determining the coordinates of a point at said contoured surface, (e) repeating steps (b) through (d) to determine all of the points desired at said contoured surface.

5. The method of claim 4 comprising fabricating said component having said contoured surface resulting from connecting said points.

6. The method of claim 4 wherein said P2 ranges from 0.4 to 1.1 inches water column.

7. A burner comprising:

a motor driven blower;

an air tube having an inlet end portion and an outlet end portion;

a blower housing forming an air flow path between said blower and said air tube;

a nozzle for spraying liquid fuel toward the outlet end portion of said air tube;

a conduit for feeding the fuel to said nozzle;

a two-stage air control device comprising a first air flow restrictor disposed upstream of said nozzle in the air tube relative to a direction of air flow and a second air flow restrictor disposed near said nozzle;

linking structure that operatively connects said first air flow restrictor and said second air flow restrictor together; and a mechanism adapted to adjust the position of both said first air flow restrictor and said second air flow restrictor to control air pressure and flow rate with a single adjustment;

wherein said first air flow restrictor is configured and arranged relative to said second air flow restrictor so as to reduce a blower pressure P1 upstream of said first flow restrictor to a lower throttled pressure P2 between said first air flow restrictor and said second air flow restrictor for each setting of said mechanism between a minimum setting and a maximum setting, said first air flow restrictor comprising a central throttle member and a throttle ring disposed around said throttle member which are movable relative to each other, one of said throttle member and said throttle ring being a perforated plate and the other of said throttle member and said throttle ring comprising a contoured peripheral surface, wherein slopes of said contoured surface and the size of a periphery of said plate form an aperture of various widths therebetween upon relative movement of the throttle member and throttle ring, which is effective to enable the blower pressure P1 to drop and the air flow rate to increase essentially uniformly with an adjustment in a setting of said mechanism while the throttled pressure P2 follows a prescribed value for each air flow rate and corresponding fuel flow rate of the burner.

8. The burner of claim 7 wherein said throttle member is said perforated plate and moves along said central axis and said throttle ring comprises said contoured surface and is affixed in said air tube.

9. The burner of claim 7 wherein said ring comprises said contoured surface with a curvature that extends progressively inwardly relative to the air flow direction.

10. The burner of claim 7 wherein said second air flow restrictor comprises a circular retention plate and a retention ring which are concentric with the air tube and configured to deliver air to a flame zone near said nozzle at an optimal velocity and flow rate for each corresponding fuel rate of the burner.

11. The burner of claim 7 wherein said fuel conduit is moveable along a central axis of said air tube and is an integral part of said two-stage air control device.

12. The burner of claim 7 wherein said mechanism is disposed outside said housing and can move said conduit axially between positions corresponding to the minimum setting and the maximum setting.

* * * * *

UNITED STATES PATENT AND TRADEMARK OFFICE
Certificate

Patent No. 6,382,959 B2 Patented: May 7, 2002

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Victor J. Turk, Elyria, OH; John M. Laisy, N. Royalton, OH; Len Fisher, Colrain, MA; and Charles L. Green, Nanuet, NY.

Signed and Sealed this Thirtieth Day of March 2004.

IRA S. LAZARUS
*Supervisory Patent Examiner*
Art Unit 3749